United States Patent [19]

Behr

[11] Patent Number: 4,502,499

[45] Date of Patent: Mar. 5, 1985

[54] MESSAGE BANK

[76] Inventor: Iley F. Behr, 10847 Hortense St., #3, North Hollywood, Calif. 91602

[21] Appl. No.: 425,643

[22] Filed: Sep. 28, 1982

[51] Int. Cl.[3] ..... G07D 9/00

[52] U.S. Cl. ..... 133/6; 221/8

[58] Field of Search ..... 221/8, 265, 4; 46/2; 133/5, 6, 8 R, 4 R; 232/4 R, 5

[56] References Cited

U.S. PATENT DOCUMENTS 1,693,458 11/1928 Patterson ..... 221/8

3,242,931 3/1966 Wandrey ..... 133/6

*Primary Examiner*—Stanley H. Tollberg

*Attorney, Agent, or Firm*—Roger A. Marrs

[57] ABSTRACT

A storage bank is disclosed herein having a cylindrical body provided with an open-ended passageway for holding a plurality of message tokens or coins. A pair of discs are rotatably carried on and separated by the body and each of the discs includes an aperture or hole for sequentially registering alternately with the opposite ends of the passageway whereby a token or coin may be either introduced to the passageway for storage or collected from the passageway preparatory for dispensing. The opposite ends of the body are capped by fixed end members which encase the pair of discs while a turning knob couples to the discs for rotation about the body. Each end member includes a hole arranged in spaced apart relationship and in a non-coaxial alignment along an arc in alignment with the holes in the respective discs. A selected one of the discs carries a printed message for display via a viewing aperture in an adjacent end member. A timing relationship is established between the end of the printed message and the dispensing of the token or coin.

4 Claims, 7 Drawing Figures

MESSAGE BANK

BACKGROUND OF THE INVENTION

1. Field of the Invention

The present invention relates to storage banks and more particularly to a novel bank which contains a printed message on a token or coin and a printed message on a display disc wherein the message token or coin is dispensed at the end of a message presentation on the disc.

2. Brief Description of the Prior Art

In the past, it has been the conventional practice to employ a variety of containers as banks for storing coins or tokens. Generally, the container includes a slot in its side through which the coin or token is introduced into the interior of the container for storage. Sometimes, the tokens or coins include a message such as a slogan, advertising matter, political messages or the like. In other instances, the container may include a pop up written display of a similar type of message when the token is introduced into the container. In some instances, a combination of both token display and pop up display are incorprated into the same container.

However, no prior attempt has been made to correlate the message on the token or the coin with the printed message on the display and to relate the dispensing of the message token or coin at a precise moment when the message display has been presented. The advantage of timing the dispensing of the token or coin with the end of the message involves insuring that the user of the bank or container will be a captive audience viewing the message display until the end of the message at which time the additional message on the token or coin is delivered to the user.

Therefore, a long standing need has existed to provide a novel coin or token storage bank or container which not only includes token or coin storage but provides for a dual message presentation in the form of a message token or coin and a message display which are coupled together by a time sequencing mechanism so that the token or coin is dispensed at the end of the message display.

SUMMARY OF THE INVENTION

Accordingly, the above difficulties and problems are obviated by the present invention which provides a novel token or coin storage apparatus having a storage means and a rotary dispensing means operably connected to the storage means whereby a selected one of a plurality of coins or tokens in a stack are dispensed exteriorally of the storage means. Also included is a visual message display operably carried between the dispensing means and the storage means whereby a printed message is displayed or presented as the dispensing means is being operated and timing means are included for dispensing or releasing a selected one of the coins or tokens at the end of the message display presentation.

Therefore, it is among the primary objects of the present invention to provide a novel storage container for message tokens and coins that further includes a message display timed to terminate presentation with the release of a token or coin.

Another object of the present invention is to provide a coin or token storage device such as a bank or the like which is a novelty item in that a variety of messages and graphic subject matter can be presented in a coordinated and timed relationship with respect to a visual presentation and dispensing of a coin or token.

Another object of the present invention is to provide a novel kind of bank for containing a plurality of messages and slogans and for timing their release or presentation to the viewer in accordance with a predetermined sequence.

Yet another object of the present invention is to provide a novel storage container for message tokens or coins which is relatively inexpensive to manufacture and assemble.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 1:
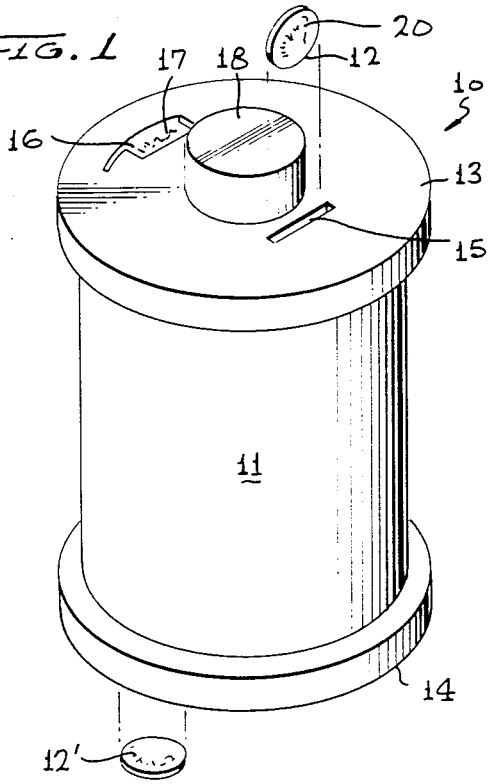
FIG. 1 is a perspective view of the novel message bank or container of the present invention.

Referring to FIG. 1, the novel message bank or container as shown in the general direction of arrow 10 and includes a cylindrical body 11 for storing a stack of coins or tokens. A typical token is indicated by numeral 12 which contains a message, indicia, graphic subject matter or the like. The bank or container further includes end members 13 and 14 which cap the opposite ends of the storage body 11. End member 13 includes an elongated slot 15 adapted to insertably receive the coin or token 12 and end member 13 further includes an elongated aperture 16 through which a printed message is displayed as indicated by numeral 17. The message 17 may be of any suitable character such as a mathematical formula, a slogan, political phrase or the like. However, it is to be understood that the printed message 17 is longer than the length of the aperture 16 so that a portion of the message is concealed until such time as the turning knob 18 is rotated which progressively introduces additional or previously concealed message information to the viewer via the aperture 16.

A feature of the invention resides in the fact that when the message 17 has been fully passed through the aperture 15 the coin 12 will be released from the opposite end of the container and such a released coin is indicated by numeral 12 prime. Not only is the sequence of importance to the present invention but an additional feature resides in the coordination of the printed message 17 with the message, indicia, pictorial subject matter or the like carried on the coin or token 12. Such material is indicated by numeral 20 on coin or token 12.

Figure 2:
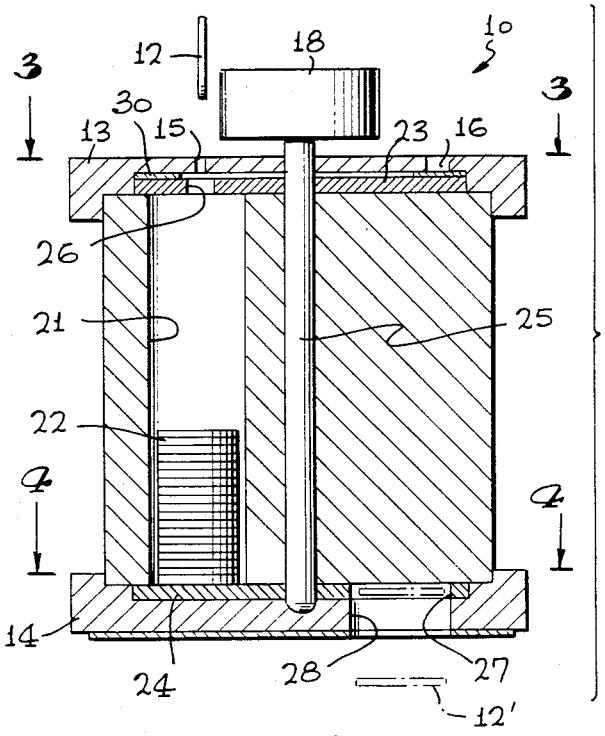
FIG. 2 is a longitudinal cross-sectional view of the message bank shown in FIG. 1.

Referring now in detail to FIG. 2, it can be seen that the storage body 11 includes an open ended passageway 21 which holds a stack of coins indicated by the numeral 22. The opposite ends of the storage body 11 are provided with a pair of discs 23 and 24 which are coaxially disposed with respect to the body 11 and are coupled together by a central shaft 25 passing through the center of the body 11 so that when knob 18 is rotated, shaft 25 will rotate discs 23 and 24 accordingly. It is to be particularly noted that the disc 23 includes a hole or slot 26 which when in alignment with the slot 15 permits entrance of the token or coin 12 to be passed into passageway 21 for storage on top of the stack 22. It can also be seen that the disc 24 includes a hole 27 so that when the disc 24 is rotated placing the hole 27 in alignment with the passageway 21, the lowermost coin in the stack will enter hole 21 and rest on top of end member 14. In this position, the coin will be carried in hole 27 on the top of end member 14 in an arcuate path until alignment of hole 27 occurs with a dispensing hole 28 in the end member 14. At this time, gravity will cause the coin 12 prime to drop from its containment.

From the foregoing, it can be seen that a time relationship is established starting with the collection of the lowermost coin in the stack in the hole 27 to the time that the hole 27 is aligned with hole 28. Also, it is to be understood that the hole opening 26 is in spaced apart relationship with respect to the hole 28 but it is also to be understood that both of these holes or openings lie on an arcuate path followed by the hole 27. This arrangement is necessary since the slot or opening 26 must lie on the passageway 21 and the opening or hole 27 must pass under the passageway 21 for collection of the coin and carry the coin to opening 28.

The side of disc 23 opposite from its side adjacent to storage body 11 carries a message display member 30 and the member 30 is arranged to lie directly under the viewing aperture 16 so that when the disc 23 is rotated, a first portion of the message will appear in the aperature followed by subsequent portions until the end of the message has been reached. It is at this point in time that it is desired to dispense the coin 12 prime so that placing the viewing aperture 16 over the hole 28 in cap member 14 assures that arranging the indicia 17 on the member 30 will place the end of the message at aperture 16 as the coin is dispensed.

Figure 3:
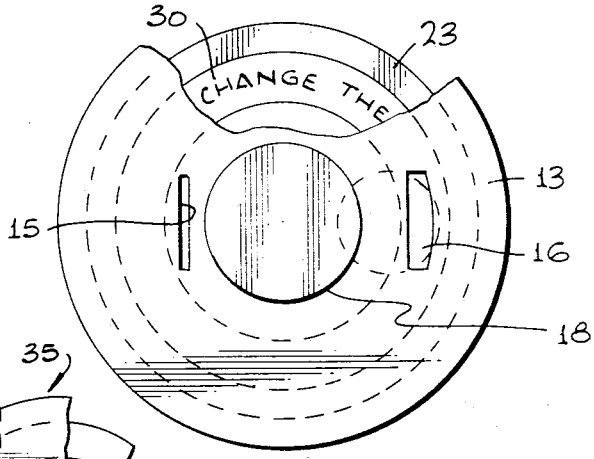
FIG. 3 is a top plan view, partly broken away, of the message container shown in FIG. 2 as taken in the direction of arrows 3—3 thereof.

Referring to FIG. 3, it can be seen that the member 30 is circular and includes a surface area for carrying the indicia 17. The circular member 30 is coaxially disposed and mounted on the upper disc 23 so that the indicia 17 will pass through the window or aperature 16 when the knob 18 is turned. The remainder of the time of rotation, the indicia is concealed underneath the end member 13. It can also be seen that the aperature or window 16 is in vertical alignment with the holes 27 and 28 when the end of the message or indicia is viewed through the aperature or window 16. Therefore, a timing means is provided by the relationship of the window or aperature 16, the hole 28 in the end cap 14 and the rotatably moving hole 27 in disc 24.

Figure 4:
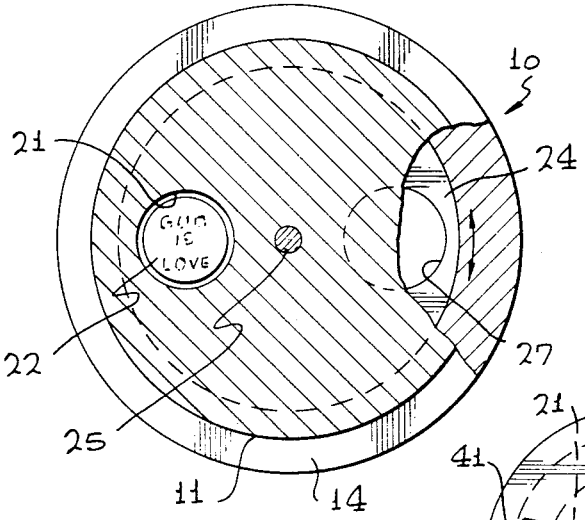
FIG. 4 is a transverse cross-sectional view of the message bank or container shown in FIG. 2 as taken in the direction of arrows 4—4 thereof.

Referring now in detail to FIG. 4, it can be seen that the disc 24 carrying hole 27 is rotated about the shaft 25 and that the circular path of hole 27 will align hole 27 with the passageway 21 so that the coin from the stack 22 is captured by the hole 27. Also, the coin in the stack is provided with a surface for carrying indicia such as a message, phrase, slogan or other graphic subject matter. The subject matter carried on the token or coin is directly related to the indicia or message carried on the member 30 and viewed through the window 16.

Figure 5:
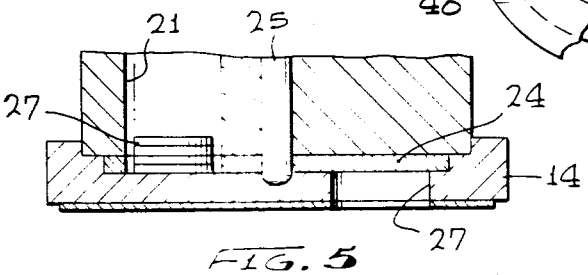
FIG. 5 is a fragmentary sectional view of the bank or container shown in FIG. 2 illustrating the position of the coin stack preparatory for dispensing.

As shown in FIG. 5, the disc 24 has been rotated by shaft 25 and knob 18 so that hole 27 is in alignment with the passageway 21 and the stack of coins 22 has moved downwardly so that one or two coins in the stack are captured by the hole 21. Normally, only a single coin would be held in the hole 27; however, for clarification purposes two coins are shown as occupying the hole. It is to be understood that the thickness of the disc 24 determines how many coins or tokens will be held within the hole 27.

Figure 7:
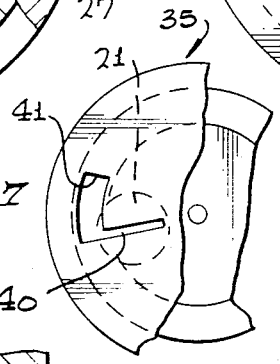
FIG. 7 is a fragmentary plan view of the message bank or container shown in FIG. 6.
Figure 6:
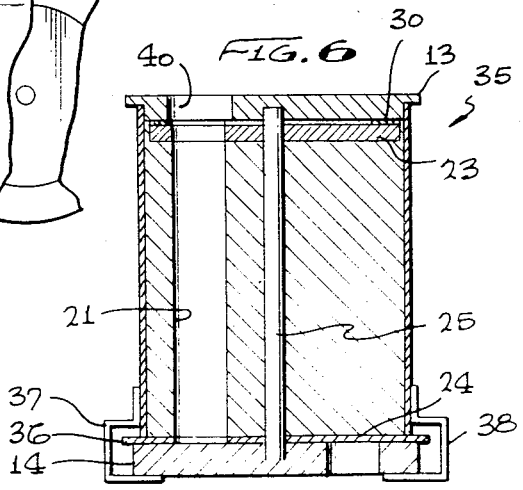
FIG. 6 is a longitudinal cross-sectional view of another embodiment of the present invention.

Referring to FIGS. 6 and 7, another embodiment of the present invention is illustrated wherein the knob 18 is eliminated and the shaft 25 is rotated an edge marginal region 36 outwardly projecting from the disc 24 beyond the exterior surface of the body 11. The end member 14 is retained to the body 11 by means of brackets 37 and 38.

Also, as shown in FIG. 7, a slot 40 is provided in the end member 13 which is directly over the storage chamber or passageway 21 and the slot 40 is in communication with the aperture or window 41 through which the indicia carried on member 30 may be viewed. Member 30 is carried on disc 23 in the same manner as previously described. The only variation or difference between the embodiments resides in the method of turning the discs 23 and 24. In the first embodiment, knob 18 is used for rotating the discs while in the embodiment of FIG. 6, the peripheral edge 36 is used for rotating the discs.

In view of the foregoing, it can be seen that the novel coin or token storage bank of the present invention provides a novel means for holding a plurality of messages in the form of indicia carried on a token or coin in a stack and that the contents of the message may be directly related to an additional message which is carried on the member 30 by indicia 17. This latter information is available for viewing through the aperature or window 16 and timing means are provided whereby at the end of the message appearance in the aperature or window 16, a bottommost coin in the stack will be dispensed through the dispensing hole 27 in the end member 14. The timing sequence is determined by the length of time taken for the hole 27 in the disc 24 to revolve from beneath the passageway 21 to the dispensing outlet or hole 28.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A coin storage and dispensing apparatus comprising:

a storage means for holding a quantity of coins in a stack;

rotary dispensing means carried on said storage means operable to select one of said stacked coins for dispensing exteriorly of said storage means;

visual message display means disposed between said storage means and said dispensing means whereby a printed message is presented during operation of said dispensing means;

timing means coupled between said display means and said dispensing means for releasing said selected coin at the conclusion of said printed message presentation;

said storage means is a cylindrical body having an open-ended passageway substantially occupied by said coin stack;

said display means and said dispensing means comprising a pair of discs rotatably carried on and separated by said body;

shaft means interconnecting said discs so as to rotate in unison about opposite ends of said body;

each of said discs having an aperture for sequentially registering alternately with opposite ends of said body passageway for introducing a coin into said passageway or selecting a coin from said stored stack preparatory for dispensing therefrom; and a base member immediately adjacent to said dispensing disc of said pair having a release hole therein adapted to pass said selected coin when aligned with said dispensing disc aperture.

2. The invention as defined in claim 1 wherein:

said disc having said aperture for introducing coins to said passageway is further provided with a message display aperture;

said timing means includes coaxial disposition of said pair of discs on said shaft means and said respective disc apertures for display and selection arranged at least 180 degrees apart.

3. The invention as defined in claim 2 wherein:

said selected coin includes a second printed message thereon.

4. The invention as defined in claim 3 including:

said first printed message disposed in an arcuate path with said coin dispensing aperture and said display aperture.

* * * * *